US007843286B2

(12) United States Patent
Kley et al.

(10) Patent No.: US 7,843,286 B2
(45) Date of Patent: Nov. 30, 2010

(54) DIELECTRIC RESONATOR FILTER HAVING A TUNABLE ELEMENT ECCENTRICALLY LOCATED AND A METHOD OF PRODUCTION THEREOF

(75) Inventors: Thomas Kley, Niederrohrdorf (CH); Bruno Rhomberg, Hausen Am Albis (CH); Daniel Heinze, Zurich (CH)

(73) Assignee: Thales (FR)

( * ) Notice: Subject to any disclaimer, the term of this patent is extended or adjusted under 35 U.S.C. 154(b) by 378 days.

(21) Appl. No.: 10/537,360

(22) PCT Filed: Nov. 14, 2003

(86) PCT No.: PCT/CH03/00748

§ 371 (c)(1),
(2), (4) Date: Jan. 17, 2006

(87) PCT Pub. No.: WO2004/054033

PCT Pub. Date: Jun. 24, 2004

(65) Prior Publication Data

US 2006/0103493 A1 May 18, 2006

(30) Foreign Application Priority Data

Dec. 11, 2002 (CH) ..... 2112/02

(51) Int. Cl.
*H01P 1/20* (2006.01)

(52) U.S. Cl. ..... 333/202; 333/235

(58) Field of Classification Search ..... 333/202, 333/235, 219.1

See application file for complete search history.

(56) References Cited

U.S. PATENT DOCUMENTS 4,639,699 A * 1/1987 Nishikawa et al. ..... 333/202
5,049,842 A * 9/1991 Ishikawa et al. ..... 333/235
5,556,209 A 9/1996 Obara et al.
5,612,655 A 3/1997 Stronks et al.

(Continued)

FOREIGN PATENT DOCUMENTS

EP 0601369 A1 6/1994

(Continued)

OTHER PUBLICATIONS

Wei Ke Hui et al: "Dielectric Ring-Gap Resonator For Application in MMIC's" IEEE Transactions on Microwave Theory and Techniques, IEEE Inc. New York, US, vol. 39, No. 12, (Dec. 1, 1991), pp. 2061-2068, XP000241131; ISSN: 0018-9480.

*Primary Examiner*—Benny Lee
(74) *Attorney, Agent, or Firm*—Lowe Hauptman Ham & Berner, LLP

(57) ABSTRACT

A high-frequency filter arrangement comprising at least one filter consisting of a plurality of high-frequency inter-coupled cavities in which a locally fixed respective dielectric resonator element is disposed and in which a respective dielectric body can be modified, in order to tune the frequency of the filter, in the position thereof in relation to the dielectric resonator element. The structure of the inventive filter arrangement is simple, compact and economical and excellent filter and tuning properties are obtained by virtue of the fact that the dielectric body is arranged in an eccentric recess of the dielectric resonator element and that the dielectric body is rotatably arranged in the eccentric recess.

30 Claims, 13 Drawing Sheets

U.S. PATENT DOCUMENTS

| | | | | | |
|---|---|---|---|---|---|
| 5,642,085 | A * | 6/1997 | Abe et al. | 333/219.1 | |
| 6,094,113 | A * | 7/2000 | Wenzel et al. | 333/202 | |
| 6,147,577 | A * | 11/2000 | Cavey | 333/209 | |
| 6,707,353 | B1 * | 3/2004 | Yamakawa et al. | 333/202 | |

FOREIGN PATENT DOCUMENTS

| | | | |
|---|---|---|---|
| JP | 61136302 | A | 6/1986 |
| JP | 62271503 | A | 11/1987 |

* cited by examiner

DIELECTRIC RESONATOR FILTER HAVING A TUNABLE ELEMENT ECCENTRICALLY LOCATED AND A METHOD OF PRODUCTION THEREOF

CROSS-REFERENCE TO RELATED APPLICATIONS

The present Application is based on International Application No. PCT/CH2003/000748, filed on Nov. 14, 2003, which in turn corresponds to FR 2112/02 filed on Dec. 11, 2002, and priority is hereby claimed under 35 USC §119 based on these applications. Each of these applications are hereby incorporated by reference in their entirety into the present application.

BACKGROUND OF THE INVENTION

1. Field of the Invention

The invention relates to the field of radio-frequency engineering. It relates in particular to a tunable radio-frequency filter arrangement and to a method for its production.

A radio-frequency filter arrangement of this type is known, for example, from U.S. Pat. No. 6,147,577.

A single tunable dielectric resonator, in which the moving dielectric body can move linearly in the vertical or horizontal direction in a cutout in the dielectric resonator element is known, by way of example, from EP-A1-0 601 369.

2. Description of the Related Art

Transportable radio link connections (LOS=Line of Sight) have been proven for rapid and flexible construction of wire-free communication networks, in particular in rugged terrain without a suitable infrastructure, and these operate in the frequency range of two or more GHz (for example 4.4 to 5 GHz; or 14.62 to 15.23 GHz). Appropriate filters, in particular bandpass filters, are required for signal processing within the transmission and reception arrangements for such directional radio links, which filters are designed not only for individual frequencies but are automatically tunable and are distinguished by constant high Q-factors over the tuning range.

In addition to the essential electrical and radio-frequency characteristics, filters of these type must, however, also be producible at low cost, must have a robust design, and must be designed to be reliable in use and to be compact and lightweight. Space (volume) and weight, in particular, are major factors for the mobility of the overall communication system.

In the past, in order to reduce the size of the cavities for filters of these type, solutions have increasingly been proposed which have a dielectric resonator element arranged in a cavity as the tunable basic element, whose resonant configuration can be varied in order to tune the filter. One such solution is described, by way of example, in U.S. Pat. No. 6,147,577, which was initially cited. In this known solution, a first round dielectric disk (ceramic puck) is arranged in a fixed position as a resonator in each of the cavities of the filter. An identical second round dielectric disk is located parallel above the first, and can be raised vertically, and lowered again, relative to the first disk by means of an electronically controlled motor drive. The linear movement that is required for this purpose is produced by a digital stepping motor, whose rotary movement is converted to a linear movement by a complex threaded rod mechanism.

This known filter arrangement has various disadvantages: firstly, it is comparatively difficult to achieve the comparatively high accuracy and reproducibility of the disk position during a linear movement of the moveable disk, as is required for good tunability of the filter. Secondly, the adjustment mechanism that is required for the linear movement requires a very large amount of space. As can easily be seen from FIG. 4 in U.S. Pat. No. 6,147,577, the motorized adjustment mechanism that is arranged above the cavities occupies about ⅔ of the entire physical volume of the filter. Furthermore, due to the capability of the upper disk to move in the vertical direction, the cavity must be initially designed to be comparatively large.

EP-A1-0 601 369, which was likewise cited initially, proposes a single tunable dielectric resonator in which an eccentric cutout is provided in the dielectric disk that is arranged in a fixed position in a cavity, which cutout can be entered to a greater or lesser extent by a dielectric body that is shaped to match the cutout. The resonator is tuned by adjustment of the insertion depth. For this purpose, the dielectric body can be moved linearly via a holder in the form of a rod in the vertical direction (FIG. 1 in EP-A1-0 601 369) or in the horizontal direction (FIG. 2 in EP-A1-0 601 369). No further details are stated about the tuning response that can be achieved by this solution. Furthermore, no mechanically adjustment mechanism is specified either, so that this proposal should in fact be regarded just as paper prior art, and its feasibility is more than questionable. In particular, this solution proposal is also subject to the same disadvantages resulting from the linear movement as those which have already been discussed further above.

SUMMARY OF THE INVENTION

One object of the invention is thus to provide a tunable radio-frequency filter arrangement which can be produced cost-effectively, is distinguished by a particularly compact and robust design with good radio-frequency characteristics, and has an advantageous tuning response, and to specify a cost-effective and simple method for its production.

The essence of the invention is to provide, as a tunable filter module, a cavity with a dielectric resonator element which is arranged in a fixed position and has an eccentric cutout in which a dielectric body is arranged such that it can rotate. The arrangement of the body such that it can rotate in the cutout allows the dielectric resonator element to be designed to be extremely compact. The rotary movement can be designed with high precision, thus allowing high tuning accuracy and reproducibility to be achieved.

One preferred refinement of the filter arrangement according to the invention is distinguished in that the dielectric resonator element is in the form of a planar, round circular disk, and in that the dielectric body can rotate about a rotation axis which is at right angles to the disk plane of the dielectric resonator element, in that the dielectric resonator element has a predetermined thickness, and in that the dielectric body has a height in the direction of the rotation axis which is essentially equal to the thickness of the dielectric resonator element.

A development of this refinement has been found to have a particularly advantageous tuning characteristic, in which the cutout in the dielectric resonator element is a circular cylindrical through-hole which is concentric with respect to the rotation axis, in which the external dimensions of the dielectric body are matched to the cutout in the dielectric resonator element in such a way that the two are separated from one another by only narrow air gaps, and the dielectric body is bounded by two parallel planar surfaces in a first direction at right angles to the rotation axis (60), and is bounded by two cylindrical envelope surfaces, which are concentric with respect to the rotation axis, in a second direction, which is at right angles to the rotation axis and to the first direction.

Undesirable interference fields in the dielectric resonator element and in the metallic cavity are preferably suppressed by the dielectric resonator element having a central through-hole.

It is also expedient for the dielectric resonator element and the dielectric body to be each composed of the same material.

The filter arrangement has a particularly simple and compact design, overall, if, according to another development, the at least one filter is accommodated in a preferably rectangular filter housing, in that the filter housing is formed from a base plate and wall plates, which are at right angles to the base plate for the side walls, and is covered on the top face by a motor mounting plate, which is parallel to the base plate, and in that the cavities in the filter are formed by separating plates which are incorporated in the filter housing and are at right angles to the base plate, and mounting slots are provided in the base plate, in the wall plates and in the separating plates, by means of which the plates are plugged into one another and are connected to one another, in particular by being soldered. The electromagnetic interaction of the cavities is in this case achieved in a particularly simple manner in that coupling openings, in particular coupling slots, are provided at predetermined points in individual separating plates.

Another development of the invention is distinguished in that a preferably circular opening is provided in the motor mounting plate above each of the corresponding cavities, through which the respective dielectric resonator element and the respective dielectric body are held in the cavity, in that the dielectric resonator element and the dielectric body are part of a tuning element which is associated with the cavity and is mounted on the motor mounting plate, and in that the tuning element in each case has a fixed holder, which passes through the opening in the motor mounting plate, for the dielectric resonator element, a holder which passes through the opening in the motor mounting plate and is mounted such that the holder can rotate, for the dielectric body, a motor, in particular a stepping motor, and a gearbox unit, which transmits the rotational movement of the motor to the holder.

The arrangement is particularly compact if, according to one preferred development, the gearbox unit is accommodated in a housing, in that the housing is mounted on a motor mounting plate, in that the motor is flange-connected to the housing, and in that the holder for the dielectric resonator element is attached to the housing.

Particularly precise tuning is achieved in that the gearbox unit has a rotating element which is known in the form of a shaft, is mounted in a prestressed precision bearing and is firmly connected to the holder for the dielectric body, and in that the rotating element is driven by a drive shaft within the gearbox unit via a gearwheel which is firmly seated on the rotating element, with the drive shaft being connected to the motor and engaging with the gearwheel via a worm gear, and in that the rotating element is prestressed in the rotation direction in order to overcome play, preferably by means of a spiral spring.

Furthermore, space can be saved by the gearwheel being in the form of a circle segment, rather than a complete wheel. A configuration such as this in the form of a segment with a segment angle of about 100° is completely sufficient to cover the entire worthwhile adjustment range of about 90° of the dielectric body in the cutout in the dielectric resonator element.

Particularly reliable tuning with high reproducibility is achieved in that, a controller, which has a control block, a memory and an input unit, is provided in the eccentric cutouts in the dielectric resonator bodies in order to control the rotation of the dielectric bodies, in that position sensors, in particular in the form of light barriers which are connected to the control block, are provided in order to determine the initial position of the dielectric bodies in the radio-frequency filter arrangement, and in that value tables are stored in the memory and associate an appropriate angle position of the dielectric bodies with a small number of selected frequencies of the radio-frequency filter arrangement.

One preferred refinement of the method according to the invention is distinguished in that the sheet-metal parts are silver-plated, and are soldered to one another by means of a silver solder, the sheet-metal parts have mounting aids, in particular in the form of crossing slots, mounting slots and mounting lugs which are matched to one another, in that the sheet-metal parts are initially loosely plugged together by means of the mounting aids and the crossing slots, mounting slots and mounting lugs in order to form the filter housing, and the plugged-together filter housing is made mechanically robust by pushing the mounting lugs into the mounting slots, in that silver solder, preferably in paste form, is applied to the junction points between the plugged-together sheet-metal parts, and in that the plugged-together sheet-metal parts are heated, preferably in an oven, until the silver solder melts and flows into the junction points.

The production process is particularly simple and cost-effective if all of the sheet-metal parts of a filter housing are cut from a common metal sheet, which has not been silver-plated, by means of a cutting method, preferably by means of laser cutting, in such a way that the cut-out sheet-metal parts are connected to the remaining area of the metal sheet only by a small number of narrow webs, in that the metal sheet together with the cut-out sheet-metal parts is then silver-plated, in that the sheet-metal parts are detached from the metal sheet after being silver-plated, and are then used to construct the filter housing, in particular with the majority of the webs remaining at those points on the sheet-metal parts which are located outside the cavities when the filter housing is complete.

BRIEF EXPLANATION OF THE FIGURES

The invention will be explained in more detail in the following text using exemplary embodiments and in conjunction with the drawing, in which.

DETAILED DESCRIPTION OF THE EMBODIMENTS OF THE INVENTION

The tunable radio-frequency filter arrangement which is described in the following text has a filter housing (10 FIG. 1) in which a number of tuning units (40 in FIG. 8) are inserted and are screwed to the motor mounting plate (13 in FIG. 1). The filter housing and the tuning units will be explained separately. The completely assembled filter arrangement is not illustrated, for reasons of clarity.

Figure 1:
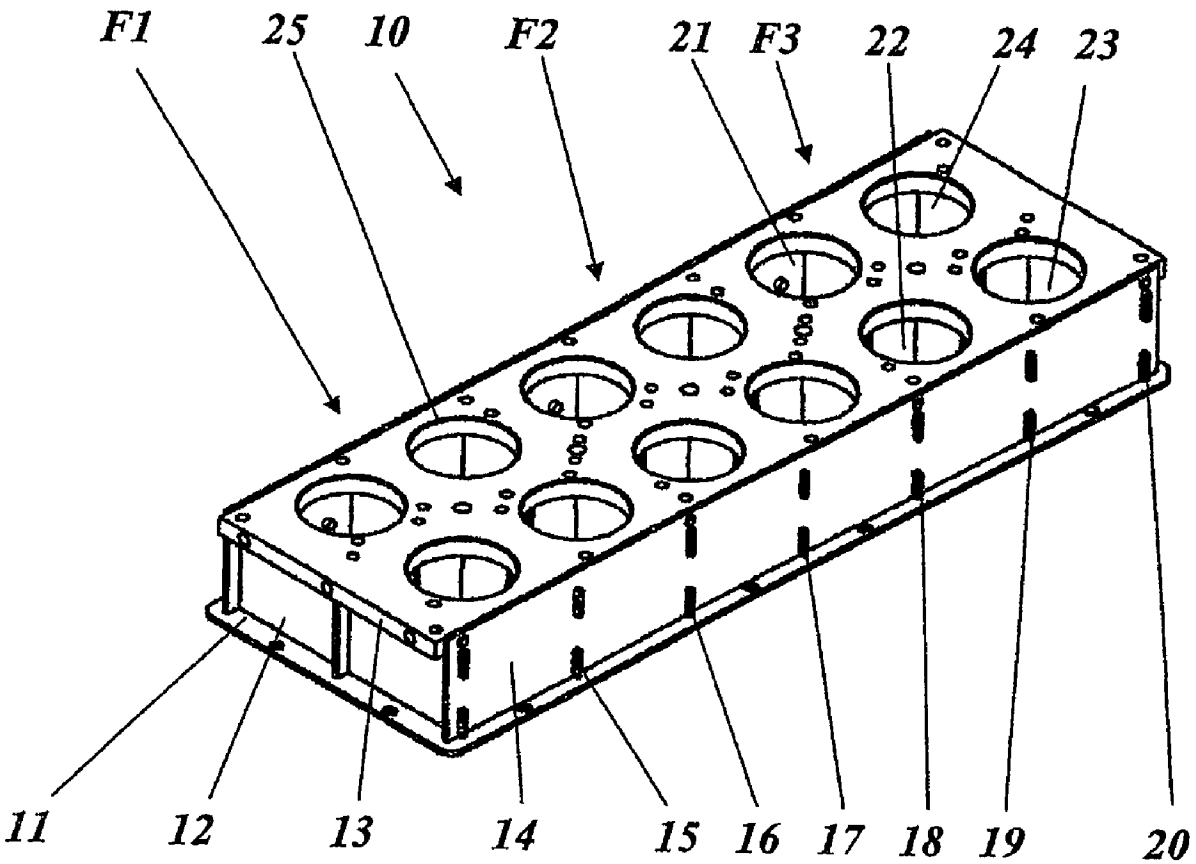
FIG. 1 shows a perspective overall view of the filter housing (the filter box) of a radio-frequency filter arrangement according to one preferred exemplary embodiment of the invention.
Figure 4:
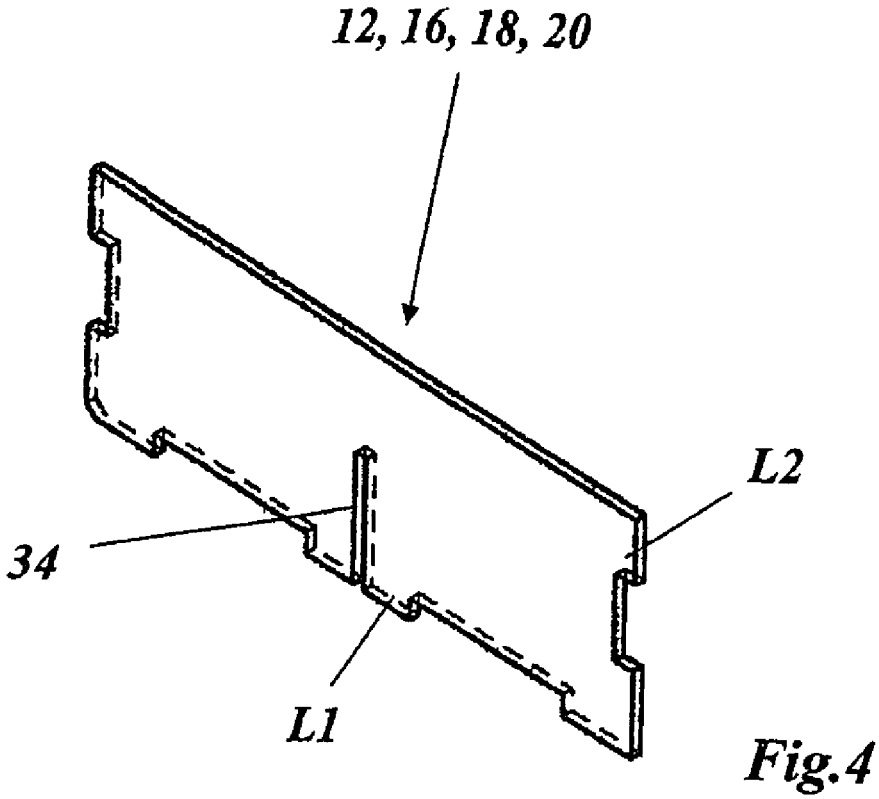
FIG. 4 shows a perspective view of a metal sheet, which is used as a wall plate for the transverse faces of the filter housing as shown in FIG. 1.
Figure 5:
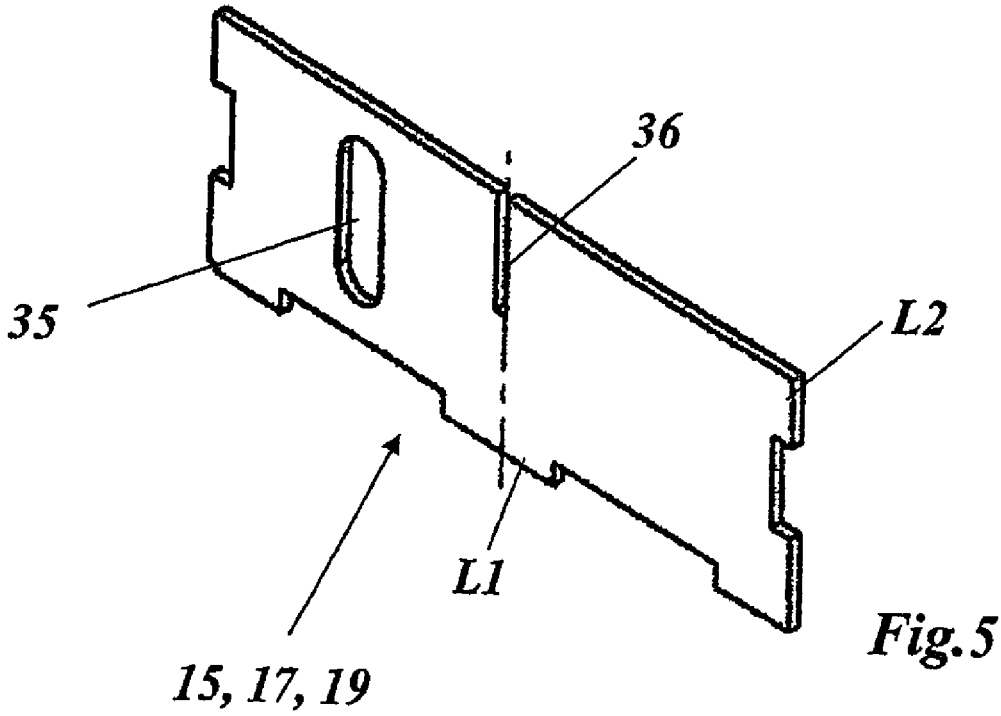
FIG. 5 shows the perspective view of a metal sheet which is used in the filter housing as shown in FIG. 1 as a transverse separating plate.

The rectangular filter housing (filter box) 10 illustrated in FIG. 1 is composed of a thicker (at the top) motor mounting plate 13 and of a number of sheet-metal parts, which form the base, side walls and (inner) separating walls of the filter housing 10. The sheet-metal parts include the baseplate 11, which is illustrated individually in FIG. 7, the wall plates 12 and 20 (see also FIG. 4) which run in the transverse direction, the wall plates 14 and 32 (FIGS. 1, 2 respectively) which run in the longitudinal direction, the transverse (inner) separating plates 15, 17,19 which are illustrated in FIG. 5, and the (inner) separating plate 33, which is located in the longitudinal direction and is illustrated individually in FIG. 6. The sheet-metal parts are composed, for example, of 1 mm thick silver-plate sheet steel (material No. 1.4301). The motor mounting plate 13 is composed of the same material and is likewise silver-plated, but has a thickness of, for example, 4 mm.

Figure 17:
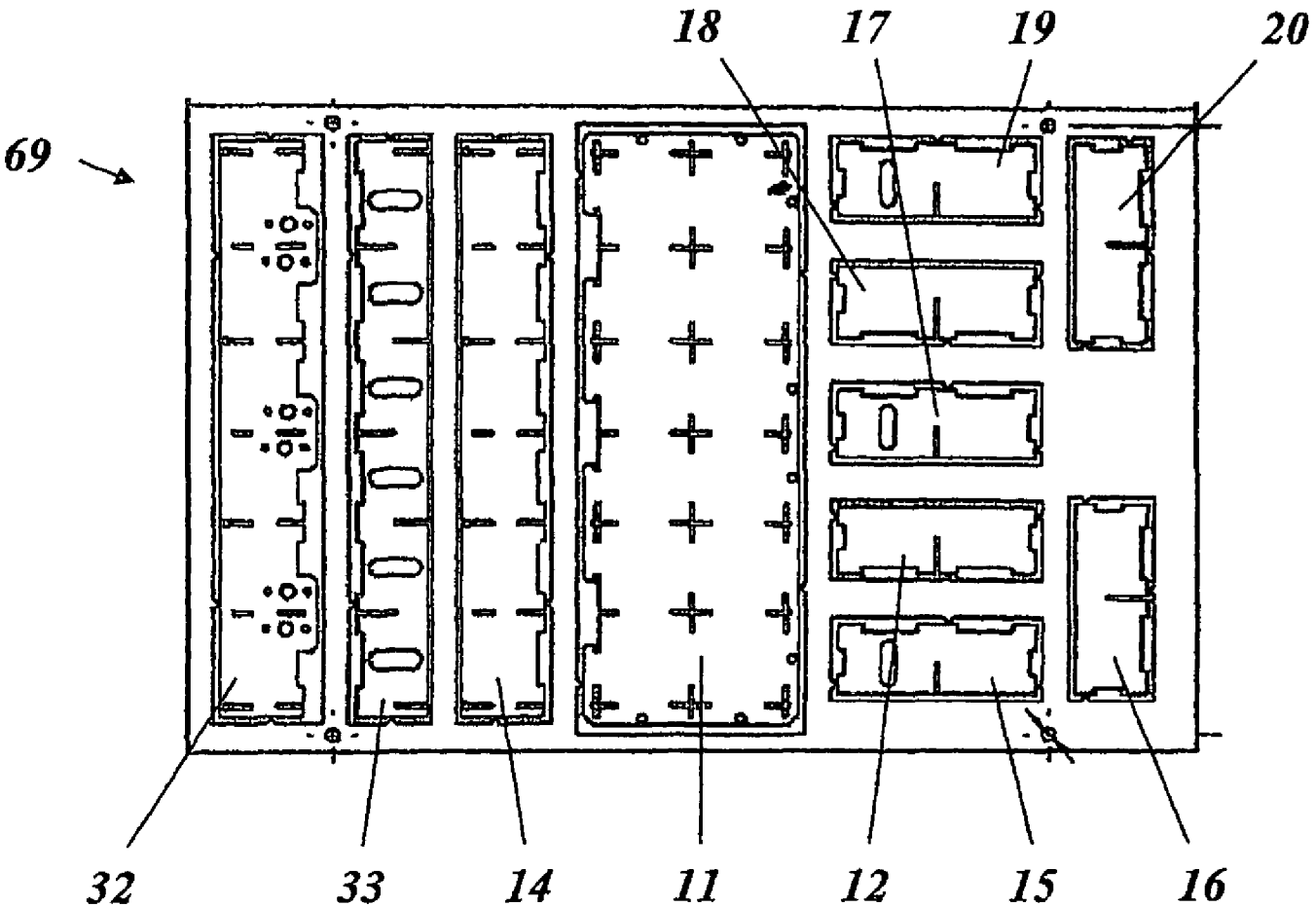
FIG. 17 shows the arrangement and configuration of the sheet-metal parts for a filter housing as shown in FIG. 1 on a common metal sheet.

As can be seen from FIG. 17, the sheet-metal parts can be produced particularly easily and cost-effectively by cutting all of the sheet-metal parts of the filter housing 10 out of a common metal sheet 69 of suitable size, in the manner illustrated in FIG. 17. First of all, the metal sheet 69 is not silver-plated. Initially, the contours of the required sheet-metal parts 11, 12, 14, . . . , 20, 32 and 33 are cut out in the metal sheet 69 by laser cutting and by a comparable cutting technique, with the sheet-metal parts that have been cut out still being connected to the rest of the metal sheet 69 at various points by narrow webs. The majority of the webs are arranged at points on the sheet-metal parts which are located outside the cavities 21, . . . , 24 in the subsequent filter housing 10. The lack of any silver layer at these points means that there will be no affects on the radio-frequency characteristics of the cavities. Once the cut metal sheet 69 is in the form shown in FIG. 17, a silver layer is provided over its entire surface. This results in the sheet-metal parts being virtually completely silver-plated. Such silver plating is missing only in the areas of the webs which will later be cut through. However, since these are largely located outside the cavities, this is not disadvantageous.

The filter housing 10 is formed from the individual sheet-metal parts 11, 12, 14, . . . , 20; 32, 33 and the motor mounting plate 13 by soldering and pinning. The soldering is carried out by means of a suitable silver solder in an oven. The sheet-metal parts 11, 12, 14, . . . , 20; 32, 33 are for this purpose first of all provisionally connected by plugging mounting lugs and mounting slots that are provided for this purpose into one another, and the sheet-metal housing that is formed is made mechanically robust by pushing the mounting lugs into the mounting slots. Only the wall plates 14, 32 on the longitudinal face of the filter housing 10 are pinned at the upper edge to the end faces of the motor mounting plate 13. A suitable amount of solder in the form of solder paste is applied to the junction points between the sheet-metal parts and is distributed such that the gaps at the junction points are reliably closed during the soldering process. The housing that has been prepared in this way is then heated in an oven to the temperature required for soldering, and is cooled down again once the solder has melted and has run in the junction points.

Figure 6:
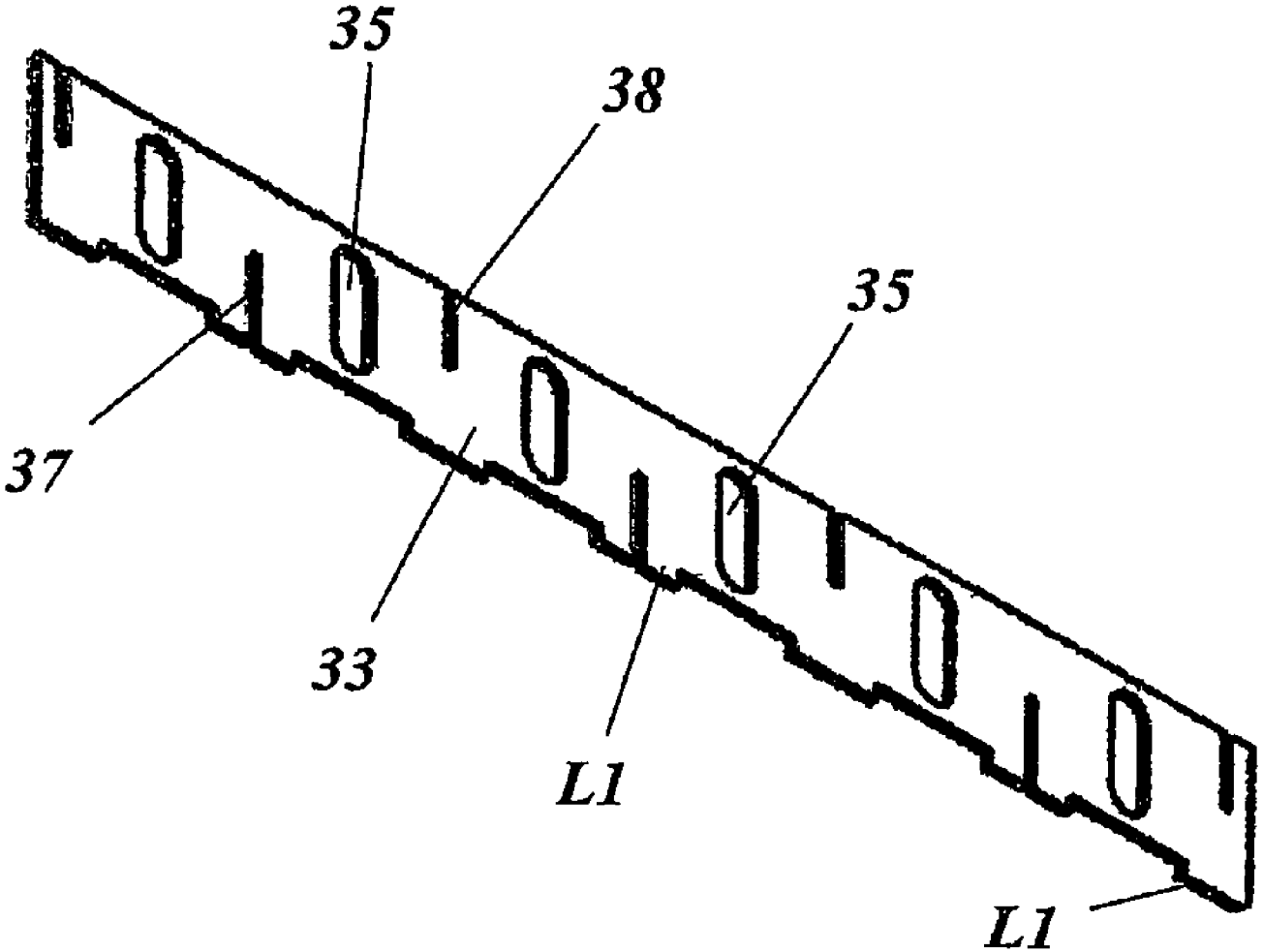
FIG. 6 shows the perspective view of a metal sheet which is used in the filter housing as shown in FIG. 1 as a separating plate.
Figure 7:
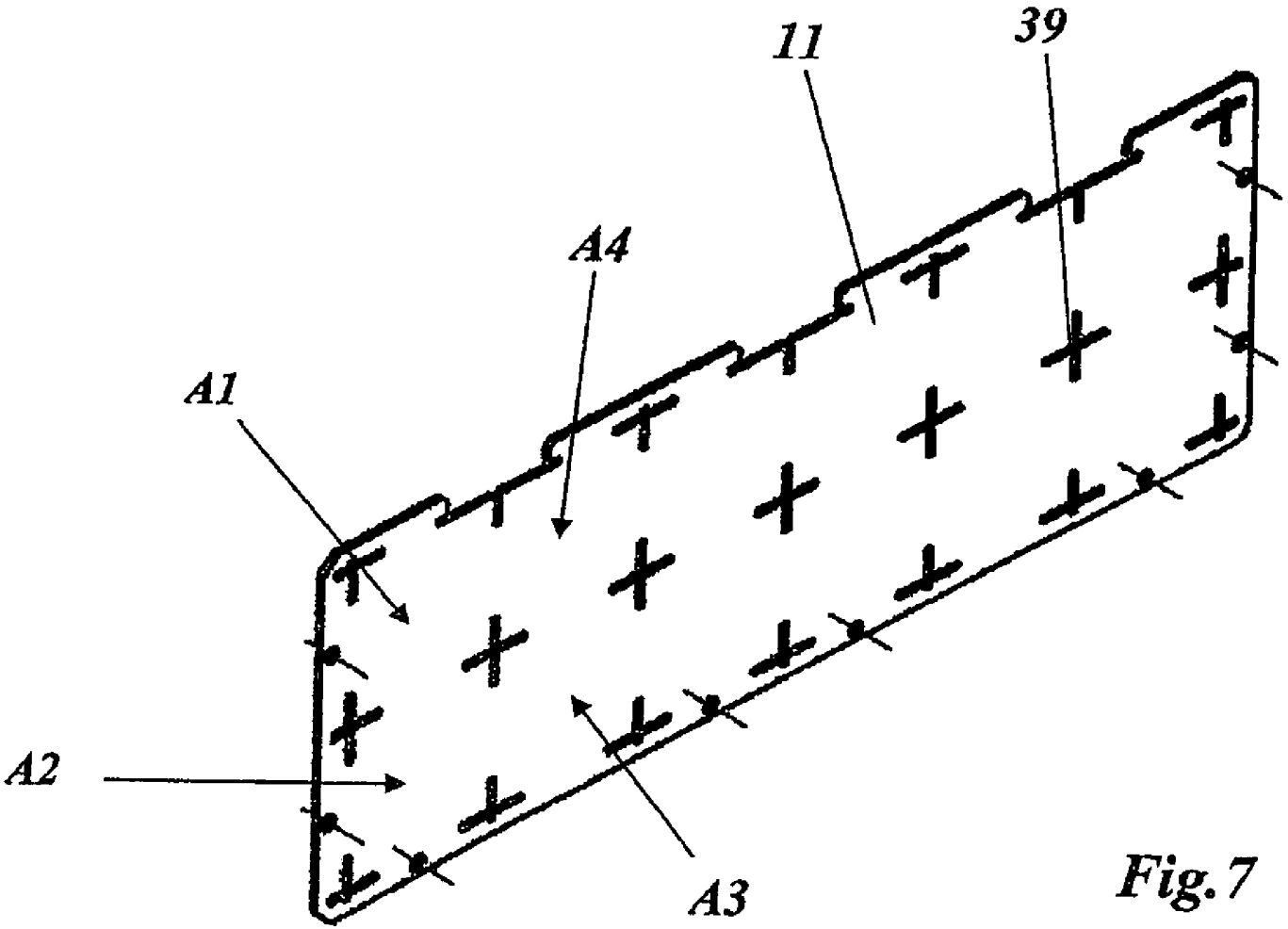
FIG. 7 shows the perspective view of the base plate of the filter housing as shown in FIG. 1 with a large number of mounting slots.

In order to plug the sheet-metal parts 11, 12, 14, . . . , 20; 32, 33 into one another, the baseplate 11 and the wall plates 14, 32 which are arranged on the longitudinal faces of the housing are, as shown in FIG. 7, provided with a number of mounting slots 39 (some of which cross). The wall plates 12, 14, 20 and 32 and the separating plates 15, . . . , 19 and 33 are equipped on their lower edges with mounting lugs L1 (FIGS. 4, 5 and 6) appropriate for this purpose, by means of which they can be plugged through the mounting slots 39 in the baseplate 11, and can be soldered. The transverse wall plates 12 and 20 and separating plates 15, . . . , 19 additionally have mounting lugs L2 (FIGS. 4 and 5) on their side edges, which can be plugged through corresponding mounting slots in the longitudinal wall plates 14, 32, and can be soldered. In order to allow unimpeded crossing of the transverse wall and separating plates 12, 14, . . . , 20; with the longitudinally running separating plate 33, special crossing slots 34, 36, 37 and (FIGS. 4-6) are provided in these sheet-metal parts. In this case, the crossings are alternate on the upper face and lower face (alternating crossing slots 37, 38 in FIG. 6).

Figure 2:
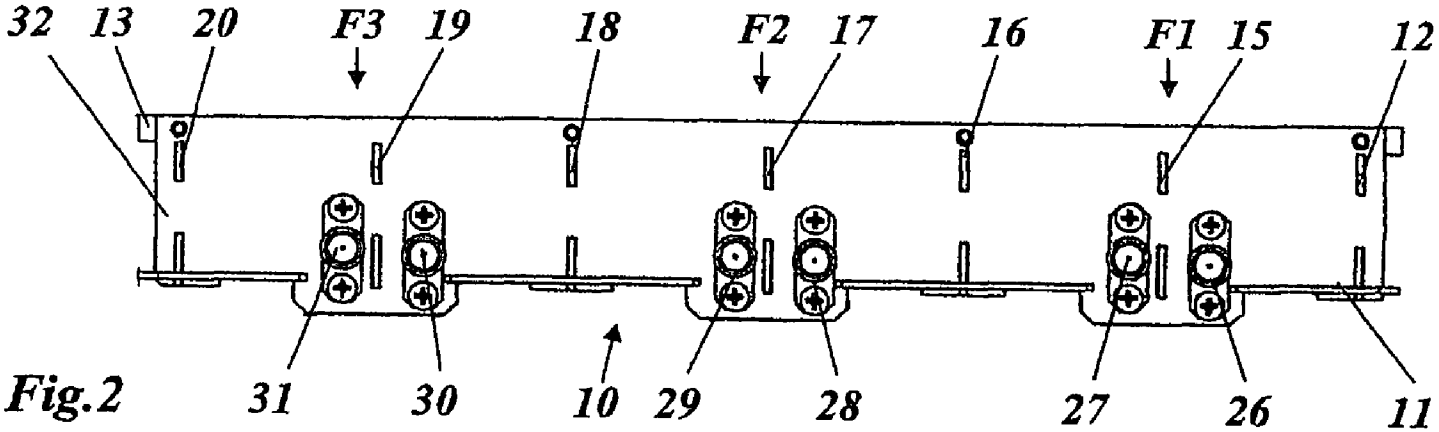
FIG. 2 shows the filter housing from FIG. 1, in the form of a side view of the longitudinal face with the inputs and outputs of the three filters.
Figure 3:
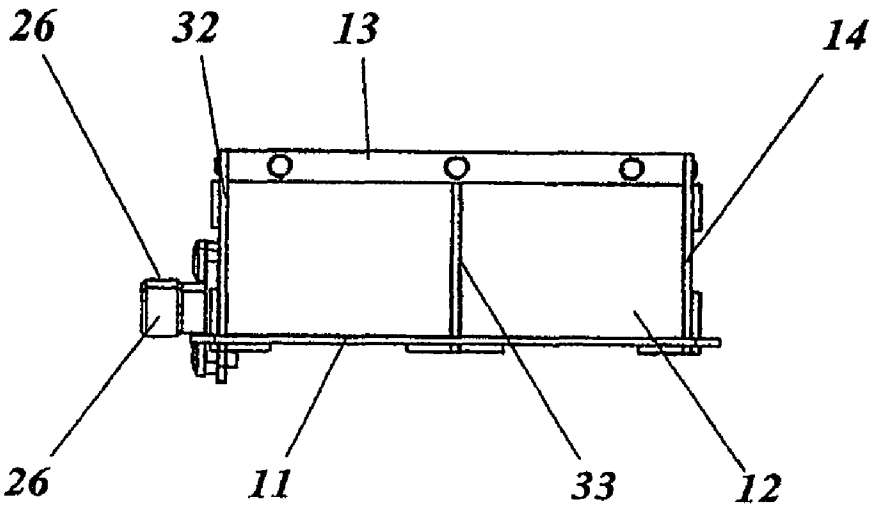
FIG. 3 shows the filter housing from FIG. 1, in the form of a side view of the transverse face.

The longitudinally running separating plate 33 and the transverse separating plates 15, . . . , 19 result in a total of 3×4=12 identical cavities, each with a square base area (A1, A2, A3, A4 in FIG. 7) being formed in the filter housing 10, four associated cavities of which are annotated, by way of example, with the reference symbols 21,22, 23, 24 in FIG. 1. The four associated cavities 21,22, 23, 24 which are arranged in a square form a filter F3. In addition to the filter F3, the filter housing 10 shown in FIG. 1 has two further identical filters F2 and F1 which likewise each comprise four cavities arranged in a square. Each of the filters F1, F2 and F3 as shown in FIG. 2 has an associated input 26, 28, 30, and an output 27, 29, 31, respectively.

The four cavities of each of the filters F1, F2 and F3 are coupled to one another for radio-frequency purposes. This is achieved by means of suitably arranged, elongated coupling slots 35 in the transverse separating plates 15, 17, and 19 (FIG. 5) and in the longitudinally running separating plate 33 (FIG. 6). The coupling slots 35 are positioned in the present example such that they are located in the center of the wall of the adjacent cavity and on the vertical center plane of the cavities to be coupled. The importance of this position for the coupling characteristics will be described in more detail later. The transverse separating plates 16 and 18 which separate the filters F1, F2 and F3 from one another are, of course, not equipped with coupling openings.

Figure 8:
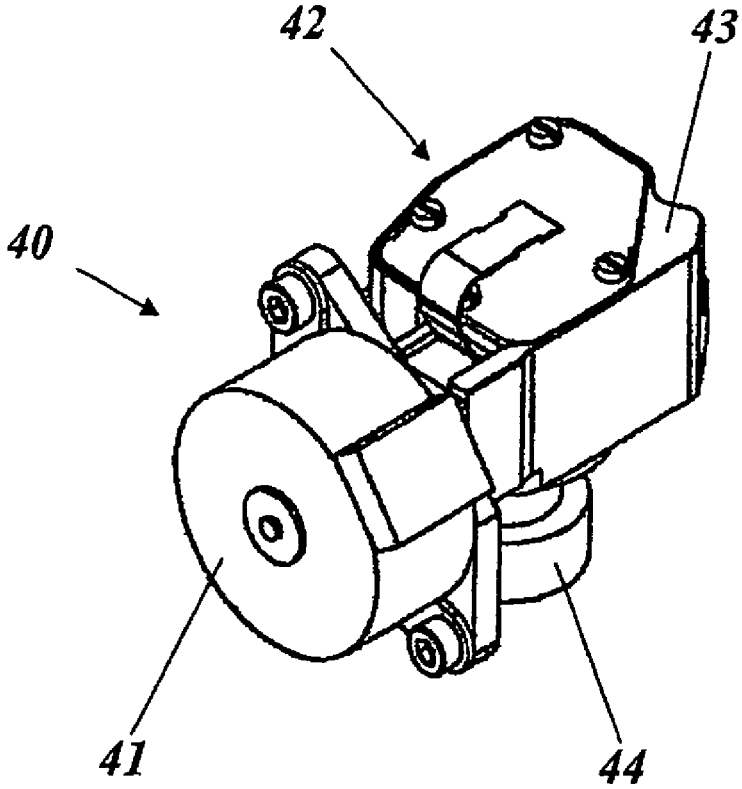
FIG. 8 shows the perspective view of a tuning unit with a motor, a gearbox unit, a dielectric resonator element and a dielectric body which can rotate.
Figure 9:
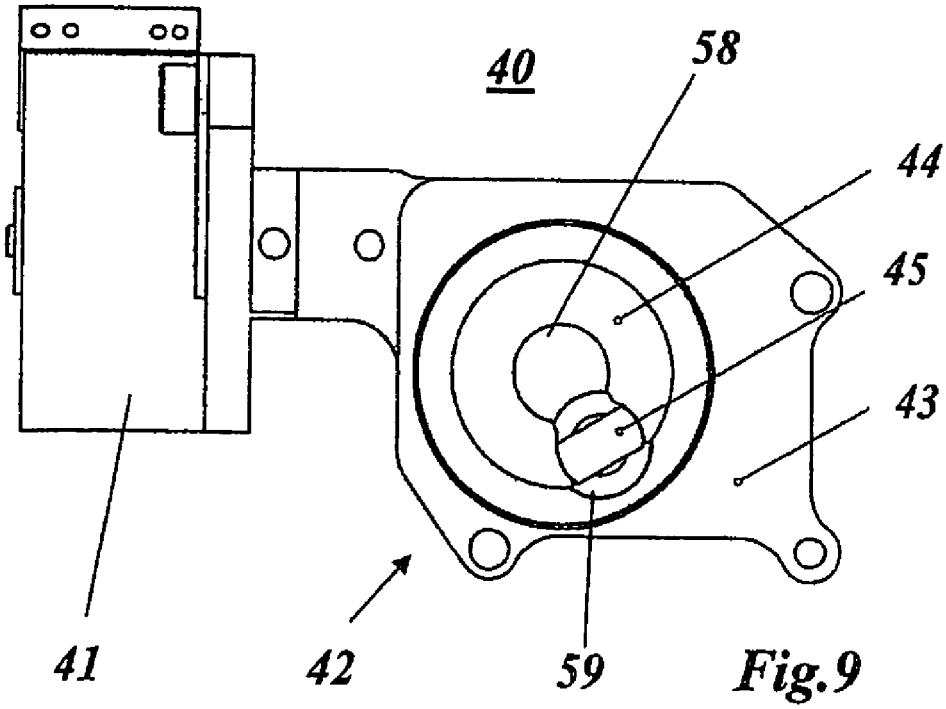
FIG. 9 shows the tuning element from FIG. 8, in a view from underneath.
Figure 10:
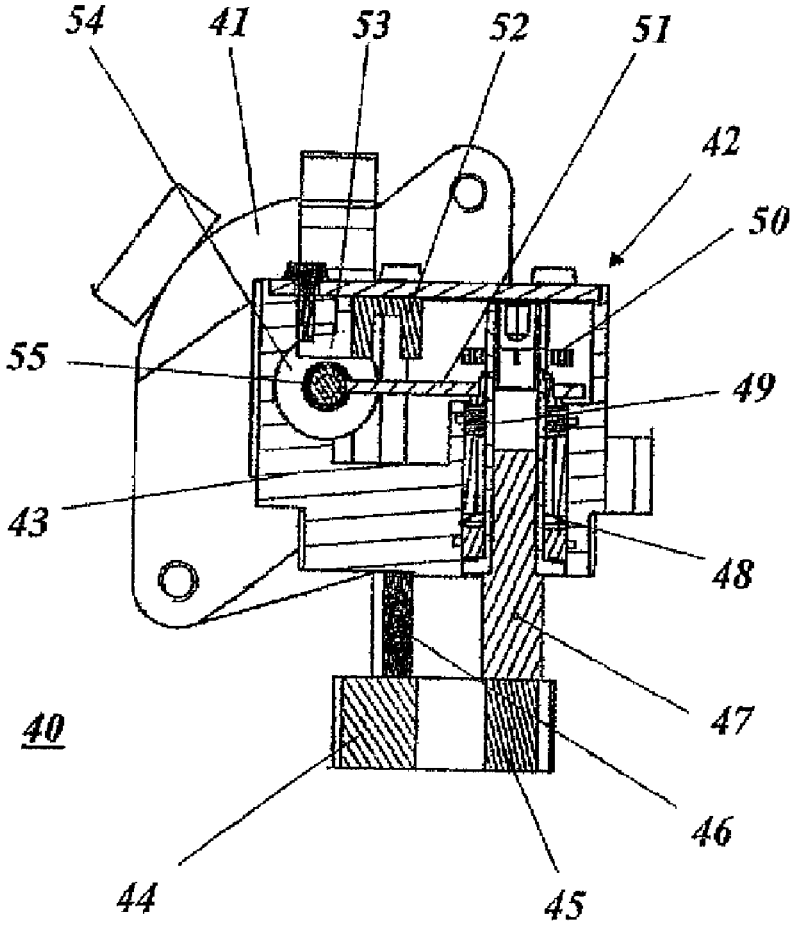
FIG. 10 shows a longitudinal section through the gearbox unit of the tuning unit from FIG. 8.

A circular dielectric resonator element 44 (FIG. 12) in the form of a disk is arranged in the center of each of the cavities 21, . . . , 24 formed in the filter housing 10 and governs the overall radio-frequency and transmission characteristic of the individual cavity and of the respective filter. The dielectric resonator element 44 is part of a compact tuning unit 40 that is associated with each cavity (FIGS. 8-10). The tuning unit 40 is screwed onto the robust motor mounting plate 13 from above and has a fixed holder 46 (FIG. 10), to end of which the dielectric resonator element 44 is attached, which projects through a (circular) opening 25 (FIG. 1), which is associated with the cavity, into the cavity located underneath.

Figure 12:
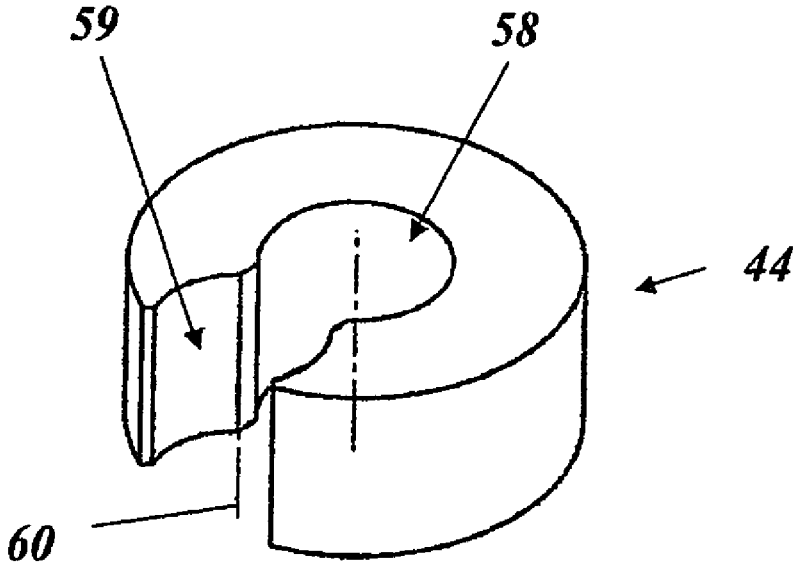
FIG. 12 shows the perspective view of the dielectric resonator element of the tuning element shown in FIG. 8.
Figure 13:
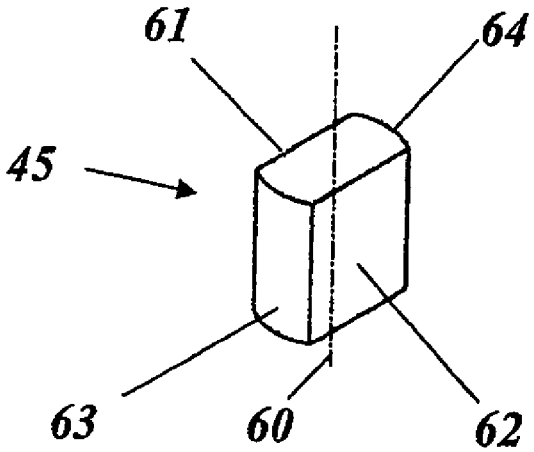
FIG. 13 shows the perspective view of the dielectric body, which can rotate, of the tuning unit shown in FIG. 8.

The dielectric resonator element 44 has a central circular through-hole 58 and an eccentrically arranged circular cutout 59 (FIG. 12). A dielectric body 45 (FIG. 13) of the same thickness is mounted in the eccentric cutout 59 such that it can rotate about a rotation axis 60 that is at right angles to the disk plane of the dielectric resonator element 44. The cutout 59 is in the form of a circular-cylindrical through-hole that is concentric about the rotation axis 60. The external dimensions of the dielectric body 45 are matched to the cutout 59 in such a way that the two are separated from one another only by narrow air gaps. For this purpose, the dielectric body 45 is bounded in a first direction (which is at right angles to the rotation axis 60) by two parallel, planar surfaces 61, 62, and is bounded in a second direction (which is at right angles to the rotation axis 60 and to the first direction) by two cylindrical envelope surfaces 63, 64, which are concentric about the rotation axis 60 (see FIG. 13; the body 45 inserted into the cutout can be seen in FIG. 9).

The dielectric body 45 is preferably formed from the same dielectric material as the dielectric resonator element 44. It is attached to the end of a holder 47 (FIG. 10) which is mounted such that it can rotate, and can be rotated by means of the mechanism that is accommodated in the tuning unit 40 relative to the dielectric resonator element 44, about the rotation axis 60. The rotation allows the resonant frequency of the resonator element, and thus the mid-frequency of the filter, to be varied.

The tuning unit 40 (FIGS. 8-10) essentially comprises a gearbox unit 42 and a motor 41, which is flange-connected to the gearbox unit 42 (see FIG. 10) at the side and drives the holder 47 (which can rotate) via the gearbox unit 42. The motor 41 is preferably a stepping motor. As can be seen from FIG. 10, the gearbox unit 42 has a housing 43 on whose lower face the holder 46 for the stationary dielectric resonator element 44 is mounted. A rotating element 49 in the form of a shaft is mounted by means of a precision bearing 48 such that it can rotate in a through-hole which passes through the base of the housing 43 at right angles, and this rotating element 49 is firmly connected to the holder 47 that can rotate. By way of example, a special bearing which can be prestressed, is provided with two ball bearings and is used in hard disk memories of PCs is used as the precision bearing 48. Bearings of this type can be obtained, for example, using the name "RO bearing" (after the inventor Rikuro Obara from the Japanese Company Minebea Co, Ltd. Their principle is described inter alia, in U.S. Pat. No. 5,556,209. The precision bearing 48 contributes to the achievement of a positioning accuracy of the dielectric body 45 in the region of a few micrometers, as is required for accurate tuning of the filters F1, F2 and F3.

Figure 11:
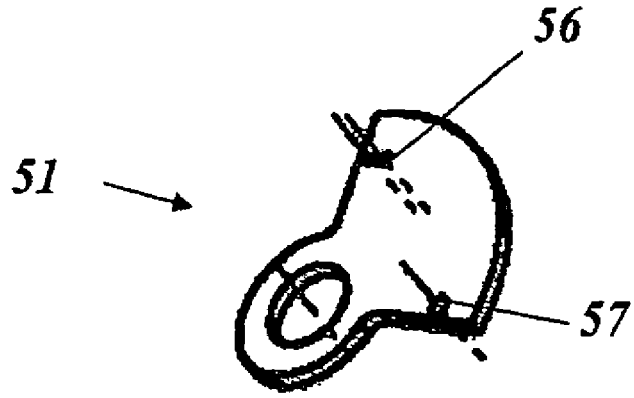
FIG. 11 shows the perspective view of the gearwheel, which is in the form of a circle segment, from the gearbox unit shown in FIG. 10.

A gearwheel 51 in the form of a circle sector is mounted on the rotating element 49, as shown in FIG. 11. Since the full tuning range of the configuration shown in FIG. 9 and comprises the dielectric resonator element 44 and the dielectric body 45 can be covered by rotation of the body through 90° from the position shown in FIG. 9, a sector angle of 100° is more than adequate for the gearwheel 51. Designing the gearwheel 51 to be in the form of a circle sector means that the gearbox unit 42 and thus the tuning unit 40 can be designed to be extremely compact The worm gear on a driveshaft 55 (FIG. 10), which is at right angles to the rotation axis 60 and is connected directly to the motor 41, engages with the gearwheel 51. In order to ensure that there is no play in the engagement between the worm gear and the gearwheel 51, the rotating element is prestressed in the rotation direction by means of a spiral spring 50, which is mounted on the housing 43. Two light barriers 52 and 53 are provided in the gearbox unit 42, in order to control the drive unit 40. The first light barrier 52 scans a marking element (not shown in FIG. 10) which is in the form of a rod, is seated in an appropriate mounting hole 56, 57 in the gearwheel 51 (FIG. 11) and marks the end points of the pivoting range. The second light barrier 53 scans a position sensor disk 54, which is seated on the driveshaft 55 and is provided with a radial slot. The interaction of the two light barriers allows the initial or zero position of the gearwheel 51, and thus the initial position of the dielectric body 45, to be determined precisely.

Figure 14:
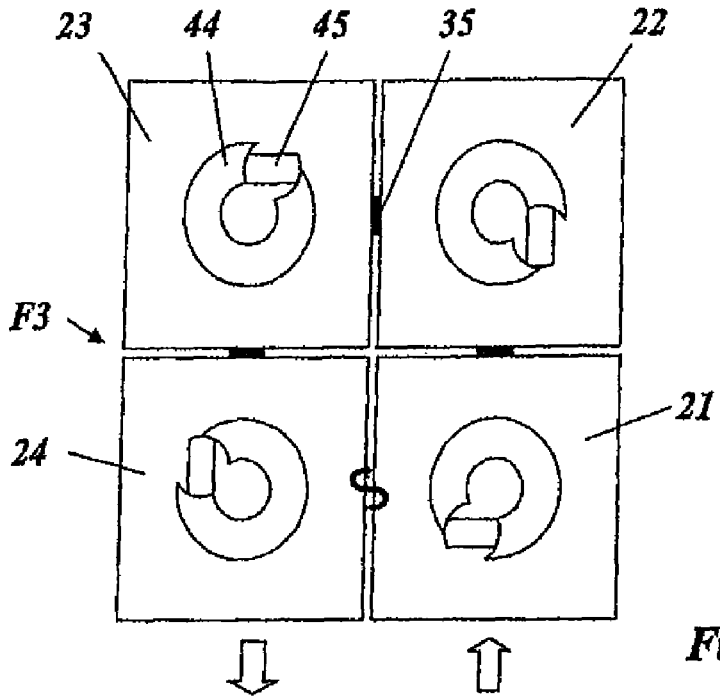
FIG. 14 shows the fundamental arrangement of the cavities of a filter in a square according to the exemplary embodiment shown in FIG. 1.

As already mentioned further above, the four cavities 21, 22, 23, and 24 with the dielectric resonator elements 44 and bodies 45 placed centrally in them are arranged in a square in each of the filters F1, F2 and F3 (see FIG. 2). This is illustrated once again in FIG. 14 on the basis of the example of the filter F3. The RF energy is injected into the first cavity 21, propagates by means of the coupling slots 35 via the adjacent cavities 22, 23 and 24, and is emitted again from the last cavity 24. The coupling slots are located on the vertical center planes or in the center of separating walls of the cavities 21, . . . , 24. The dielectric resonator elements 44 are rotated together with their eccentric cutouts 59 from the vertical center plane of the coupling slot 35 that is located closest to the cutout through a predetermined angle which, in the example, is about 57°. This particular configuration of the cutout and coupling slot results in the filter having a radio-frequency response in which the coupling factor decreases as the frequency increases, when the dielectric body 45 is rotated toward the next coupling slot. An additional degree of freedom is provided by the capability for additional coupling between the first cavity 21 and the last cavity 24, as is indicated by the S-shaped coupling element in FIG. 14.

Figure 15:
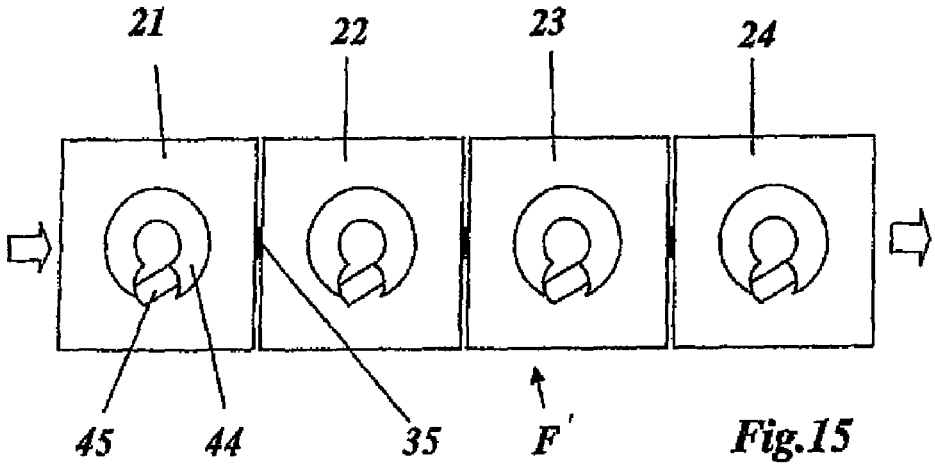
FIG. 15 shows an alternative arrangement to that in FIG. 14 of the cavities of a filter, in a row.

Another configuration of a filter F' by means of which—apart from the transverse coupling—the same effect can be achieved is for the cavities 21, . . . , 24 to be arranged as shown in FIG. 15. In this case as well, the coupling slots 35 are arranged centrally, and the dielectric resonator elements 44 are rotated, together with their cutouts, through about 60° from the center plane.

Figure 16:
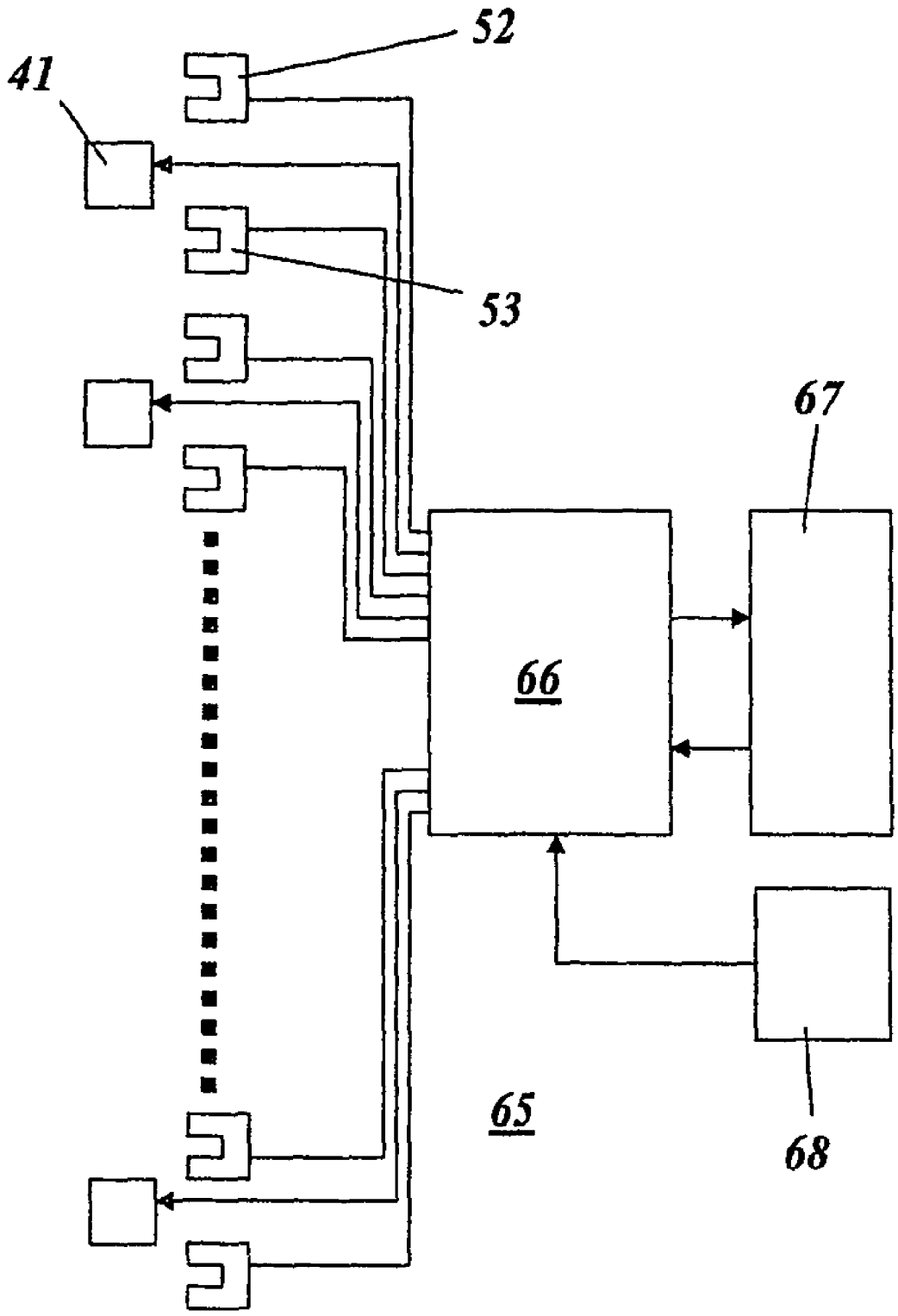
FIG. 16 shows the outline circuit diagram of a control system for the radio-frequency filter arrangement according to the invention.

A control system is provided for tuning of the filter arrangement by means of the tuning elements 40, and a highly simplified block diagram of this control system is illustrated in FIG. 16. The controller 65 has a control block 66 which, for example, has a suitable microprocessor and a number of power outputs corresponding to the number of motors 41. The control block 66 controls the stepping motors 45 via the power outputs, and is activated from the outside via an input unit 68. The control block 66 interacts with a memory (EPROM) 67, in which value tables are stored, which associate a specific step number of the stepping motors 41 with a number of selected frequency values of the filter. Intermediate values are produced by interpolation. Furthermore, the control block 66 receives signals from the two light barriers 52, 53 for each tuning unit 40. If a specific frequency for the filter or filters is intended to be set (during start-up), the dielectric bodies 45 are first of all moved back to their initial position. The reaching of the initial position is signaled by appropriate signals from the two light barriers 52, 53. The stepping motors 41 are then switched forward from the initial position by the number of steps corresponding to the table value taken from the memory 67, or to a value determined by interpolation for the desired frequency. The motors 41 for a filter may in this case all be switched largely at the same time, or may be switched following a specific algorithm.

If the radio-frequency filter arrangement with the filter housing 10 according to the exemplary embodiment (FIG. 1) is intended to be designed for a tunable frequency range from about 4.4 GHz to 5 GHz, the housing (without the tuning units) has a base area of approximately 66 mm×186 mm, and a height of approximately 30 mm. Each of the cavities has a base area (A1, . . . , A4 in FIG. 7) of 28 mm×28 mm, and a height of 20 mm. The dielectric resonator element 44 has a thickness of approximately 6 mm, an external diameter of approximately 15 mm, and an internal diameter of approximately 6.5 mm. The diameter of the eccentric cutout 59 is approximately 6 mm, the width of the dielectric body 45 between the parallel vertical boundary surfaces is approximately 3 mm. The tuning unit 40 projects only approximately 24 mm beyond the surface of the motor mounting plate 13.

Figure 18:
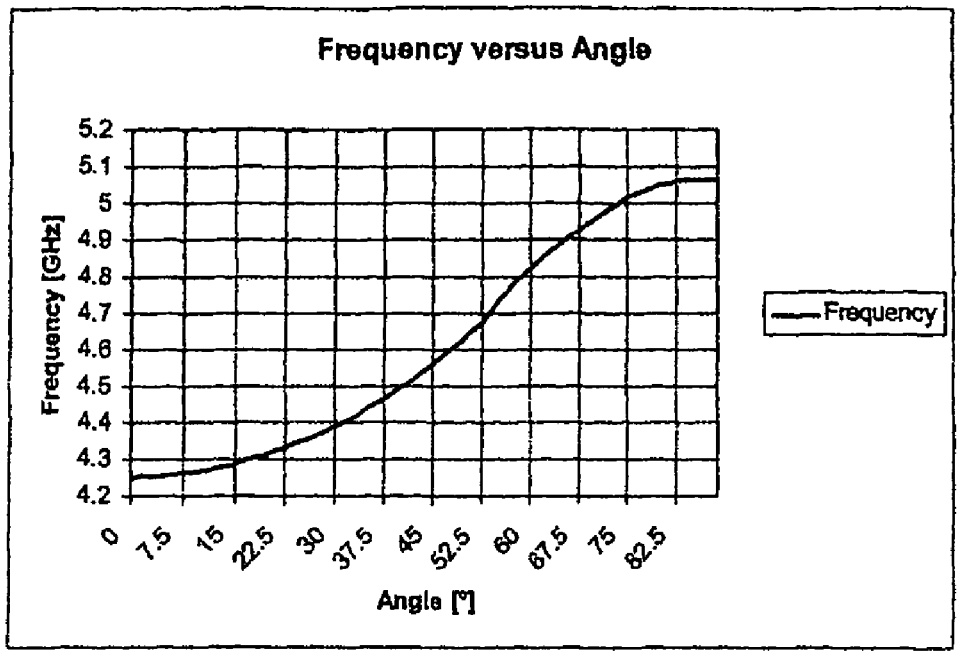
FIG. 18 shows the relationship between the filter frequency of the filter according to the exemplary embodiment and the rotation angle of the dielectric body 45.
Figure 19:
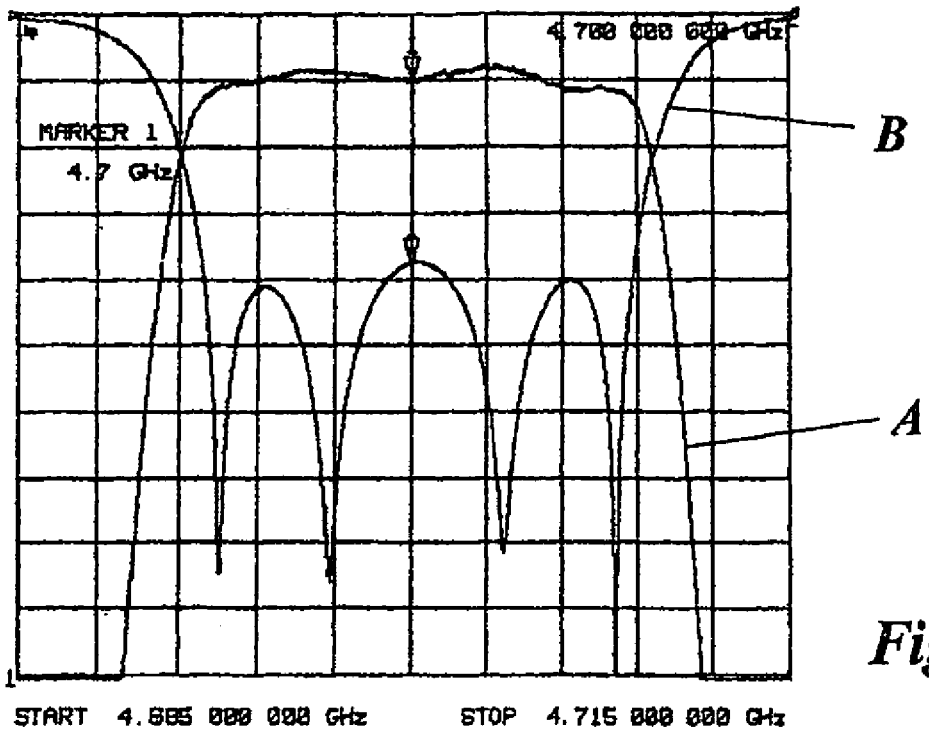
FIG. 19 shows the measured frequency profile of the S parameters S11 (reflection coefficient at the input; curve B) and S21 (transmission coefficient in the forward direction.
Figure 20:
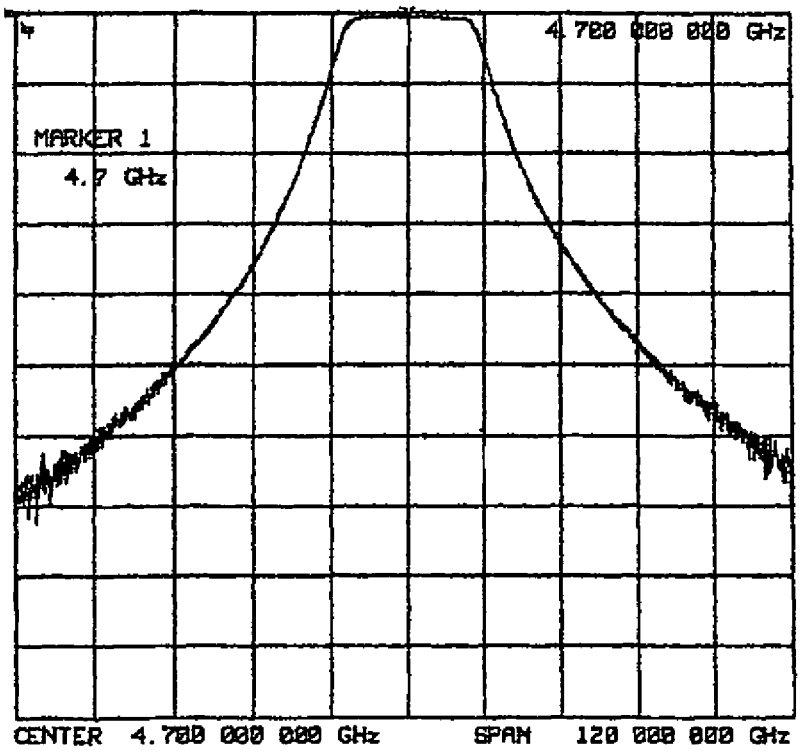
FIG. 20 shows the measured frequency profile of the S parameter S21 of the filter according to the exemplary embodiment.

Characteristic curves as are shown in FIGS. 18 to 20 are obtained for a filter arrangement designed in this way:

FIG. 18 shows the relationship between the tunable filter frequency and the rotation angle of the dielectric body 45 in the eccentric cutout 59 in the dielectric resonator element 44. The rotation angle range is from 0° to 90°. At 0° the straight sides of the dielectric body 45 are tangential with respect to the dielectric resonator elements 44.

FIG. 19 shows the measured curves for a number of S parameters of the filters according to the exemplary embodiment, specifically the reflection coefficient at the input S11 (curve B), the transmission coefficient in the forward direction, S21 (curve A), as a function of the frequency for a selected mid-frequency of 4.7 GHz. The frequency range is in this case ±15 MHz about the respective mid-frequency. The graph is logarithmic. The scale in the vertical direction is 0.5 dB per division for S21, and 5 dB per division for S11.

FIG. 20 shows the measured curve for S21 for 4.7 GHz over an extended frequency range of ±60 MHz about the respective mid-frequency. The graph is logarithmic. In this case, the scale in the vertical direction is 10 dB per division.

Overall, the invention provides a tunable radio-frequency filter arrangement which can be designed such that it is simple and costs little, can be tuned very accurately and reproducibly over a wide frequency range, is extremely compact, and is distinguished by very good radio-frequency characteristics. In particular, a number of identical filters can be accommodated in a common filter housing, with little additional complexity.

LIST OF REFERENCE SYMBOLS

10 Filter housing (Filter box)
11 Base plate
12, 20 Wall plate (transverse)
13 Motor mounting plate
14, 32 Wall plate (longitudinal)
15, 17 and, 19 Separating plate (transverse)
21,22, 23, and 24 Cavity
25 Opening (Circuit)
26,28,30 Input (Filters F1, F2, F3)
27,29,31 Output (Filters F1, F2, F3)
33 Separating plate (longitudinal)
34, 36, 37, 38 Crossing slot
39 Mounting slot
35 Coupling slot
40 Tuning unit
41 Motor (stepping motor)
42 Gearbox unit
43 Housing (Gearbox unit)
44 Dielectric resonator element (stationary)
45 Dielectric body (moving)
46 Holder (in the form of a half shell)
47 Holder (which can rotate)
48 Precision bearing
49 Rotating element
50 Spiral spring
51 Gearwheel (in the form of a circle segment)
52, 53 Light barrier
54 Position sensor disk
55 Drive shaft (with worm gear)
56, 57 Attachment hole (position sensor pin)
58 Central through-hole
59 Eccentric cutout
60 Rotation axis
61,62, 63 and 64 Boundary surface
65 Controller
66 Control block
67 Memory (EPROM)
68 Input unit
69 Metal sheet
A1, A2, A3 and A4 Surface
F,F1,F2,F3 Filter (Bandpass filter)
K1, K2 Curve
L1, L2 Mounting lug

The invention claimed is:

1. A radio-frequency filter arrangement comprising:

at least one filter which has a number of cavities which are coupled to one another for radio-frequency purposes, a respective ring-like dielectric resonator element which is arranged in a fixed position in each of the cavities, each corresponding ring-like dielectric resonator element having therein a respective eccentric through-hole, an axis of the respective eccentric through-hole is offset from an axis of the corresponding ring-like dielectric resonator element, and a respective dielectric body having the same thickness as a thickness of the corresponding ring-like dielectric resonator element, disposed in each respective eccentric through-hole so as to be rotatable about the axis of the respective eccentric through-hole and so that a position of the respective dielectric body relative to the corresponding dielectric resonator element can be varied in order to tune the frequency of the at least one filter.

2. The radio-frequency filter arrangement as claimed in claim 1, wherein the cavities are coupled by coupling slots which are each arranged on a plane, and in that the respective eccentric through-holes of the corresponding dielectric resonator elements are arranged rotated through a predetermined angle with respect to the plane about the axis of the corresponding dielectric resonator element.

3. The radio-frequency filter arrangement as claimed in claim 1, wherein the respective dielectric body can rotate about a rotation axis which is parallel with the axis of the axis of the corresponding ring-like dielectric resonator element.

4. The radio-frequency filter arrangement as claimed in claim 3, wherein the respective eccentric through-hole in the corresponding dielectric resonator element is a circular cylindrical through-hole which is concentric with respect to the rotation axis.

5. The radio-frequency filter arrangement as claimed in claim 4, wherein external dimensions of the respective dielectric body are matched to the respective eccentric through-hole in the corresponding dielectric resonator element in such a way that the respective dielectric body and corresponding dielectric resonator element are separated from one another by only narrow air gaps.

6. The radio-frequency filter arrangement as claimed in claim 5, wherein the respective dielectric body is bounded by two parallel planar surfaces in a first direction at right angles to the rotation axis, and is bounded by two cylindrical envelope surfaces which are concentric with respect to the rotation axis, in a second direction, which is at right angles to the rotation axis and to the first direction.

7. The radio-frequency filter arrangement as claimed in claim 1, wherein the corresponding dielectric resonator element has a central through-hole.

8. The radio-frequency filter arrangement as claimed in claim 1, wherein the corresponding dielectric resonator element and the respective dielectric body are each composed of the same material.

9. The radio-frequency filter arrangement as claimed in claim 1, wherein the at least one filter is accommodated in a rectangular filter housing, in that the filter housing comprises a base plate and wall plates, which are at right angles to the base plate for providing side walls, and is covered on the top face by a motor mounting plate, which is parallel to the base plate, and in that the cavities in the filter comprise separating plates which are incorporated in the filter housing and are at right angles to the base plate.

10. The radio-frequency filter arrangement as claimed in claim 9, wherein mounting slots are provided in the base plate, in the wall plates and in the separating plates, by means of which the plates are plugged into one another and are soldered to one another.

11. The radio-frequency filter arrangement as claimed in claim 9, wherein coupling openings are provided at predetermined points in individual separating plates.

12. The radio-frequency filter arrangement as claimed in claim 9, wherein a respective circular opening is provided in the motor mounting plate above each of the cavities, through which the corresponding dielectric resonator element and the respective dielectric body are held in the cavity.

13. The radio-frequency arrangement as claimed in claim 12, wherein the respective dielectric resonator element and the corresponding dielectric body are part of a respective tuning element which is associated with the corresponding cavity and is mounted on the motor mounting plate.

14. The radio-frequency filter arrangement as claimed in claim 13, wherein the respective tuning element has a corresponding fixed holder, which passes through the respective opening in the motor mounting plate, for the corresponding dielectric resonator element, a respective holder which passes through the corresponding opening in the respective motor mounting plate and is mounted such that the corresponding holder can rotate, for the respective dielectric body, a respective motor and a respective gearbox unit, which transmits the rotational movement of the respective motor to the corresponding holder, which is mounted such that the respective motor and the respective gearbox unit can rotate.

15. The radio-frequency filter arrangement as claimed in claim 14, wherein the respective motor is a stepping motor.

16. The radio-frequency filter arrangement as claimed in claim 14, wherein the respective gearbox unit is accommodated in a corresponding housing, in that the respective housing is mounted on the motor mounting plate, in that the respective motor is flange-connected to the corresponding housing, and in that the respective holder for the corresponding dielectric resonator element is attached to the respective housing.

17. The radio-frequency filter arrangement as claimed in claim 16, wherein the respective gearbox unit has a corresponding rotating element which is in the form of a shaft, is mounted in a prestressed precision bearing and is firmly connected to the corresponding holder for the respective dielectric body, and in that the respective rotating element is driven by a corresponding drive shaft within the respective gearbox unit via a corresponding gearwheel which is firmly seated on the respective rotating element, with the respective drive shaft being connected to the corresponding motor and engaging with the respective gearwheel via a worm gear.

18. The radio-frequency filter arrangement as claimed in claim 17, wherein the respective rotating element is prestressed in the rotation direction in order to overcome play, by a spiral spring.

19. The radio-frequency filter arrangement as claimed in claim 17, wherein the respective gearwheel is designed in the form of a circle segment.

20. The radio-frequency filter arrangement as claimed in claim 1, wherein each of the filters has four cavities with corresponding dielectric resonator elements and dielectric bodies which can rotate arranged respectively therein.

21. The radio-frequency filter arrangement as claimed in claim 20, wherein the four cavities are arranged adjacent to one another in a square-shape configuration.

22. The radio-frequency filter arrangement as claimed in claim 20, wherein a selected number of the at least one filters each have four cavities and are arranged alongside one another in a common filter housing.

23. The radio-frequency filter arrangement as claimed in claim 1, wherein a controller, which has a control block, a memory and an input unit, is provided to control the rotation of the respective dielectric body.

24. The radio-frequency filter arrangement as claimed in claim 23, wherein value tables are stored in the memory and associate an appropriate angle position of the respective dielectric body with a small number of selected frequencies of the radio-frequency filter arrangement.

25. The radio-frequency filter arrangement as claimed in claim 23, wherein position sensors, in the form of light barriers which are connected to the control block, are provided in order to determine an initial position of the respective dielectric body in the radio-frequency filter arrangement.

26. A method for production of a radio-frequency filter arrangement as claimed in claim 1, wherein a number of planar sheet-metal parts comprise the cavities.

27. The method as claimed in claim 26, wherein the sheet-metal parts are silver-plated, and are soldered to one another by means of a silver solder.

28. The method as claimed in claim 27, wherein the sheet-metal parts have mounting aids, in the form of crossing slots, mounting slots and mounting lugs which are matched to one another, in that the sheet-metal parts are initially loosely plugged together by means of the mounting aids and the crossing slots, mounting slots and mounting lugs in order to form the filter housing, and the plugged-together filter housing is made mechanically robust by pushing the mounting lugs into the mounting slots, in that silver solder, preferably in paste form, is applied to the junction points between the plugged-together sheet-metal parts, and in that the plugged-together sheet-metal parts are heated, preferably in an oven, until the silver solder melts and flows into the junction points.

29. The method as claimed in claim 26, wherein all of the sheet-metal parts of a filter housing are cut from a common metal sheet, which has not been silver-plated, by means of laser cutting, in such a way that the cut-out sheet-metal parts are connected to the remaining area of the metal sheet only by a small number of narrow webs, in that the metal sheet together with the cut-out sheet-metal parts is then silver-plated, in that the sheet-metal parts are detached from the metal sheet after being silver-plated, and are then used to construct the filter housing.

30. The method as claimed in claim 29, wherein the webs remain predominantly at those points on the sheet-metal parts which are located outside the cavities when the filter housing is complete.

* * * * *